US006047227A

United States Patent [19]

Henderson et al.

[11] Patent Number: 6,047,227

[45] **Date of Patent: *Apr. 4, 2000**

[54] METHOD AND APPARATUS FOR OPERATING GEOGRAPHY ALTERING MACHINERY RELATIVE TO A WORK SITE

[75] Inventors: Daniel E. Henderson, Washington; Craig L. Koehrsen, Peoria, both of Ill.

[73] Assignee: Caterpillar Inc., Peoria, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/752,368

[22] Filed: Nov. 19, 1996

[51] Int. Cl.[7] ..... G06F 7/70

[52] U.S. Cl. ..... 701/50; 701/49; 701/213; 701/300; 172/4.5

[58] Field of Search ..... 701/49–50, 207, 701/208, 300; 342/357, 457, 357.13, 357.17; 340/990, 995, 988; 37/347–348; 172/4.5, 9

[56] References Cited

U.S. PATENT DOCUMENTS

| | | | |
|---|---|---|---|
| 4,225,283 | 9/1980 | Baker et al. | 172/272 |
| 4,807,131 | 2/1989 | Clegg | 701/50 |
| 5,471,391 | 11/1995 | Gudat et al. | 701/50 |
| 5,493,494 | 2/1996 | Henderson | 701/50 |
| 5,612,864 | 3/1997 | Henderson | 701/50 |

*Primary Examiner*—Jacques H. Louis-Jacques
*Assistant Examiner*—Gertrude Arthur
*Attorney, Agent, or Firm*—James R. Yee; W. Bryan McPherson, III

[57] ABSTRACT

A method and apparatus for operating geography-altering machinery such as a track-type tractor, road grader, paver or the like relative to a work site to alter the geography of the site toward a desired condition. A first digital three-dimensional model of the desired site geography, and a second digital three-dimensional model of the actual site geography are stored in a digital data storage facility. The machine is equipped with a position receiver to determine in three-dimensional space the location of the machine relative to the site. A dynamic database receives the machine position information, determines the difference between the first and second site models and generates representational signals of that difference for directing the operation of the machine to bring the actual site geography into conformity with the desired site geography. In one embodiment, the signals representing the machine position and the difference between the first and second site models used to generate an operator display which is updated in real time. Alternately, the signals representing the difference between the first and second site models can be supplied to automatic machine controls for autonomous or semi-autonomous operation of the machine.

16 Claims, 8 Drawing Sheets

METHOD AND APPARATUS FOR OPERATING GEOGRAPHY ALTERING MACHINERY RELATIVE TO A WORK SITE

TECHNICAL FIELD

The present invention relates generally to a dump cycle of an earth moving machine, and more particularly, to a method for identifying a machine dump occurrence of an earthmoving machine.

BACKGROUND ART

Detection of truck dump occurrences has typically been done using expensive equipment added specifically for that purpose. For example, sensors may be added that detect the position of the hydraulic cylinder that raises and lowers the truck body. Alternatively, sensors may be added to detect the proximity of the truck body to the truck frame. Other systems, such as payload monitoring systems, use sensors that measure the weight of the truck body to determine if the body is full or empty. These types of sensors and systems add cost to a machine and may decrease the reliability of the machine. Additionally, the sensors and systems must be read as an input to any information or control system that needs to make use of the detection of the truck dump. A truck dump monitoring system is needed that can utilize hardware and software that already resides on the truck, such as vehicle tracking systems.

The present invention is directed to overcoming one or more of the problems set forth above.

FIELD OF THE INVENTION

This invention relates to the operation of machinery for altering the geography of a work site and, more particularly, to the real time generation and use of digital data which collectively represents the geography of the work site as it is being altered by the machinery toward a desired state.

As used in this patent specification the phrase "geography altering machinery" and various approximations thereof refer to self-propelled mobile machines such as track-type tractors, hydraulic excavators, mining shovels, road graders, pavers and asphalt layers which exhibit both (1) mobility over or through a work site as a result of being provided with a prime mover (for example an engine) on a frame which drives wheels or tracks supporting the frame, and (2) the capacity to alter the geography of a work site as a consequence of the provision on the frame of a tool or tool set such as a bucket, shovel, bucket, ripper or the like. Machinery such as track-type tractors, graders, pavers and asphalt layers is typically referred to as "earth moving machinery or equipment" and it is to be understood that these machines constitute a subcategory of the geography altering machinery with which this invention deals.

The subject invention is directed at overcoming one or more of the problems as set forth above.

BACKGROUND OF THE INVENTION

Despite the development of sophisticated and powerful earthmoving machinery it remains a time consuming and labor intensive chore to recontour the topography of a large plot of land, or to otherwise alter the geography of a work site such as a construction area, mine, road or the like. Such operations sometimes involve the necessity of a survey which is currently carried out using line of sight optical instruments or other static, point-by-point measuring techniques to obtain the coordinates of a large number of points over the work site and to thereafter construct a three-dimensional model of the site. From the survey an architectural plan or target geography is developed. Thereafter the site is carefully marked with stakes of various colors to provide physical cues to the operator of geography altering machinery such as a track-type tractor as to how the machine should be operated to transform the work site from the original to the desired state. Only the most skillful and experienced operators can achieve efficiency in recontouring a large land site, such difficulty being due in part to the absence of large scale as well as detailed information as to the progress being made in the revision of the site.

As a result most projects involving the alteration of the geography of large work sites are time consuming and labor intensive in the requirements for skilled personnel and large crews to direct the operation of earthmoving machinery and the like.

Additionally, for knowledge of the degree to which the original site geography has been brought into conformity with the desired geography, the operation is often interrupted while a survey crew verifies the amount of progress to date and manually updates the staking and marking of the site, as well as the site model. Between these occasional verifications the machinery operators and supervisors have no truly accurate way to measure their real time progress.

SUMMARY DISCLOSURE OF THE INVENTION

In one aspect of the present invention, an apparatus for displaying information to an operator of a mobile geography-altering machine is provided. The apparatus includes a three-dimensional positioning system located on the mobile geography-altering machine for determining the three dimensional position of the mobile geography-altering machine. A digital processor located on the machine receives position signal from the three-dimensional position system, determines a swath path related to a cutting operation of the mobile geography-altering machine and maintains a digitized site model of the actual site geography. A display screen coupled to the digital processor graphically displays site information contained in the digitized site model including the swath path to the operator.

In another aspect of the present invention, a method for displaying information to an operator of a mobile geography-altering machine is provided. The method includes the steps of determining the three dimensional position of the mobile geography-altering machine, determining a swath path related to a cutting operation of the mobile geography-altering machine, maintaining a digitized site model of the actual site geography, and graphically displaying site information contained in the digitized site model including the swath path to the operator.

DETAILED DESCRIPTION OF THE ILLUSTRATED EMBODIMENTS

Figure 1:
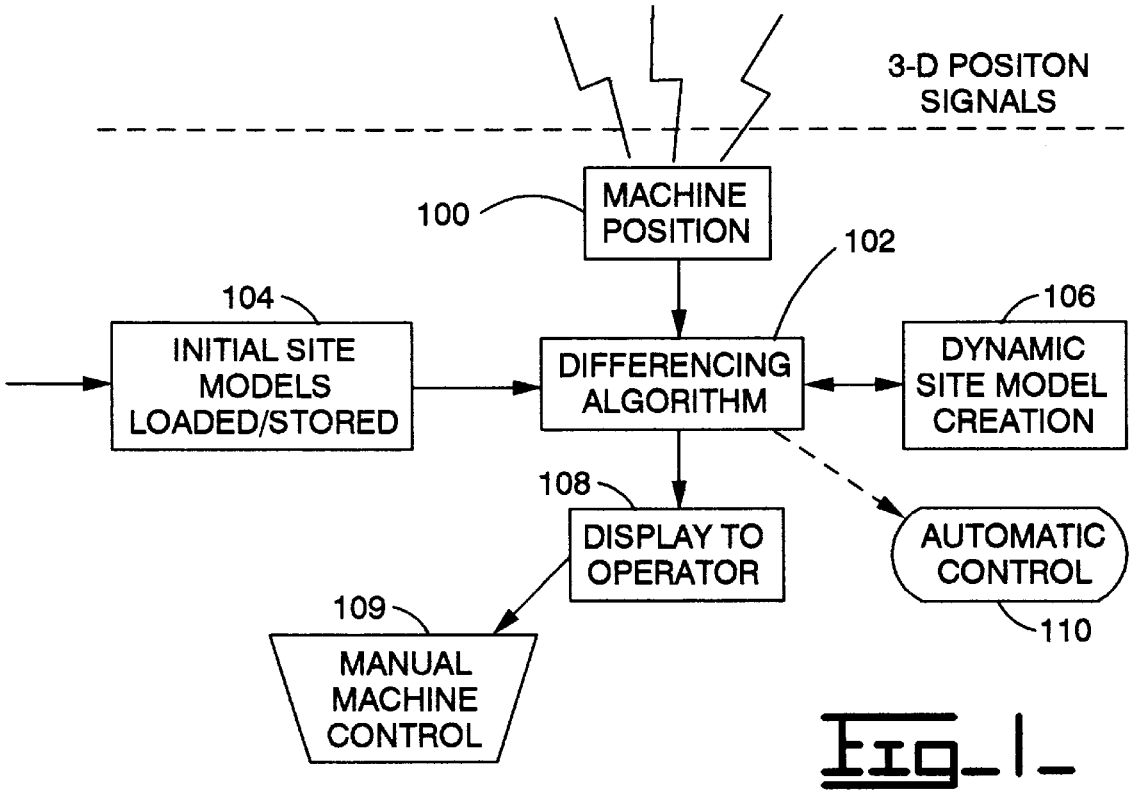
FIG. 1 is a schematic representation of a machinery position and control method according to the present invention.

Referring to FIG. 1, the method of the present invention is shown schematically. Using a known three-dimensional positioning system with an external reference, for example (but not limited to) 3-D laser, GPS, GPS/laser combinations or radar, machine or tool position coordinates are determined in block 100 as the machine moves over the site. These coordinates are instantaneously supplied as a series of discrete points to a differencing algorithm at 102. The differencing algorithm calculates the machine position and path in real time. Digitized models of the actual and desired site geographies are loaded or stored at block 104, an accessible digital storage and retrieval facility, for example a local digital computer. The differencing algorithm 102 retrieves, manipulates and updates the site models from 104 and generates at 106 a dynamic site database of the difference between the actual site and the desired site model, updating the actual site model in real-time as new position information is received from block 100. This dynamically updated site model is then made available to the operator in display step 108, providing real time position, direction and site geography/topography updates in human readable form. Using the information from the display the operator can efficiently monitor and direct the manual control of the machine at 109.

Additionally, or alternately, the dynamic update information can be provided to an automatic machine control system at 110, for example an electrohydraulic control system of the type developed by Caterpillar Inc. and used to operate the various pumps, valves, hydraulic cylinders, motor/steering mechanisms and other controls used in geography-altering machinery. The electrohydraulic controls can provide an operator assist to minimize machine work and limit the manual controls if the operator's proposed action would, for example, overload the machine. Alternately, the site update information from the dynamic database can be used to provide fully automatic machine/tool control.

It will be clear from the foregoing that with the present method the initial, actual site geography/topography model can be generated by the machine itself on previously unsurveyed terrain. By simply moving the machine over a proposed site in a regular pattern, the geography of the site can be determined relative to the desired architect's site model loaded at 104. After the machine has traversed the entire site to accurately determine its actual geography, the actual site model can then be monitored and updated in real time at 106 as the machine brings the actual geography into conformity with the desired site model.

Figure 2:
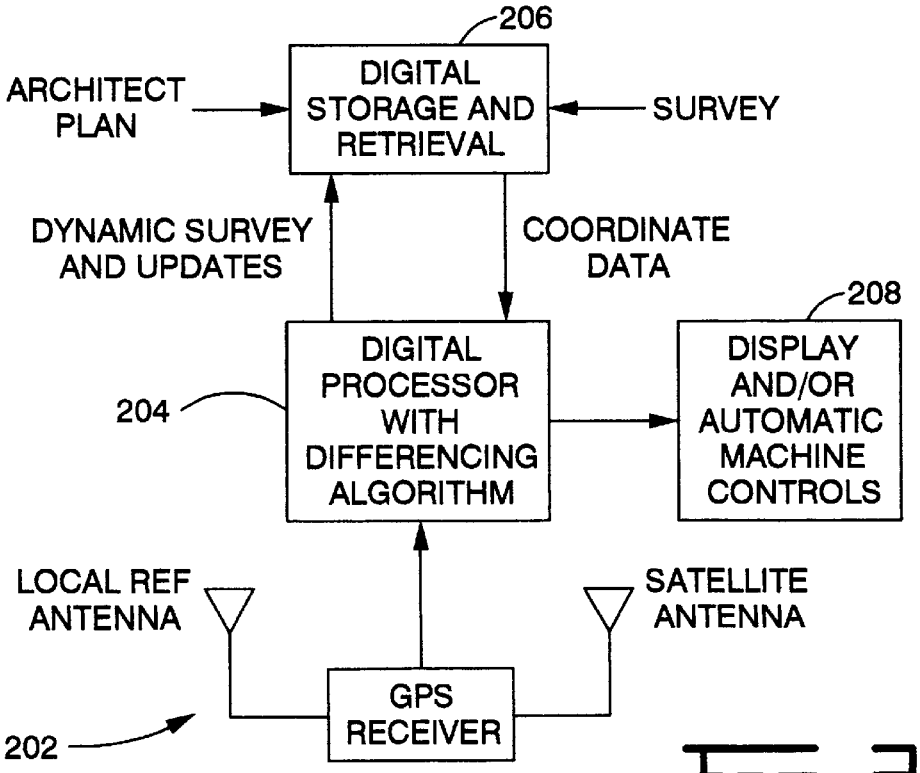
FIG. 2 is a schematic representation of an apparatus which can be used in connection with the receipt and processing of GPS signals to carry out the present invention.

Referring now to FIG. 2, an apparatus which can be used in connection with the receipt and processing of GPS signals to carry out the present invention is shown in block diagram form comprising a GPS receiver apparatus 202 with a local reference antenna and a satellite antenna; a digital processor 204 employing a differencing algorithm, and connected to receive position signals from 202; a digital storage and retrieval facility 206 accessed and updated by processor 204, and an operator display and/or automatic machine controls at 208 receiving signals from processor 204.

GPS receiver system 202 includes a satellite antenna receiving signals from global positioning satellites, and a local reference antenna. The GPS receiver system 202 uses position signals from the satellite antenna and differential correction signals from the local reference antenna to generate position coordinate data in three-dimensions to centimeter accuracy for moving objects. Alternatively, raw data from the reference antenna can be processed by the system to determine the differential correction.

This position information is supplied to digital processor 204 on a real-time basis as the coordinate sampling rate of the GPS receiver 202 permits. The digital storage facility 206 stores a first site model of the desired site geography, for example according to an architect's plan, and a second digitized site model of the actual site geography, for example as initially surveyed. The site model corresponding to the actual site geography can be accessed and updated in real time by digital processor 204 as it receives new position information from GPS receiver 202.

Digital processor 204 further generates signals representing the difference between the continuously-updated actual site model and the architect's plan. These signals are provided to the operator display and/or automatic machine controls at 208 to direct the operation of the machine over the site to bring the updated actual site model into conformity with the architect's plan. The operator display 208, for example, provides one or more visual representations of the difference between the actual, continuously-updated site model and the desired site model to guide the operator in running the machine for the necessary geography-altering operations.

Figure 3:
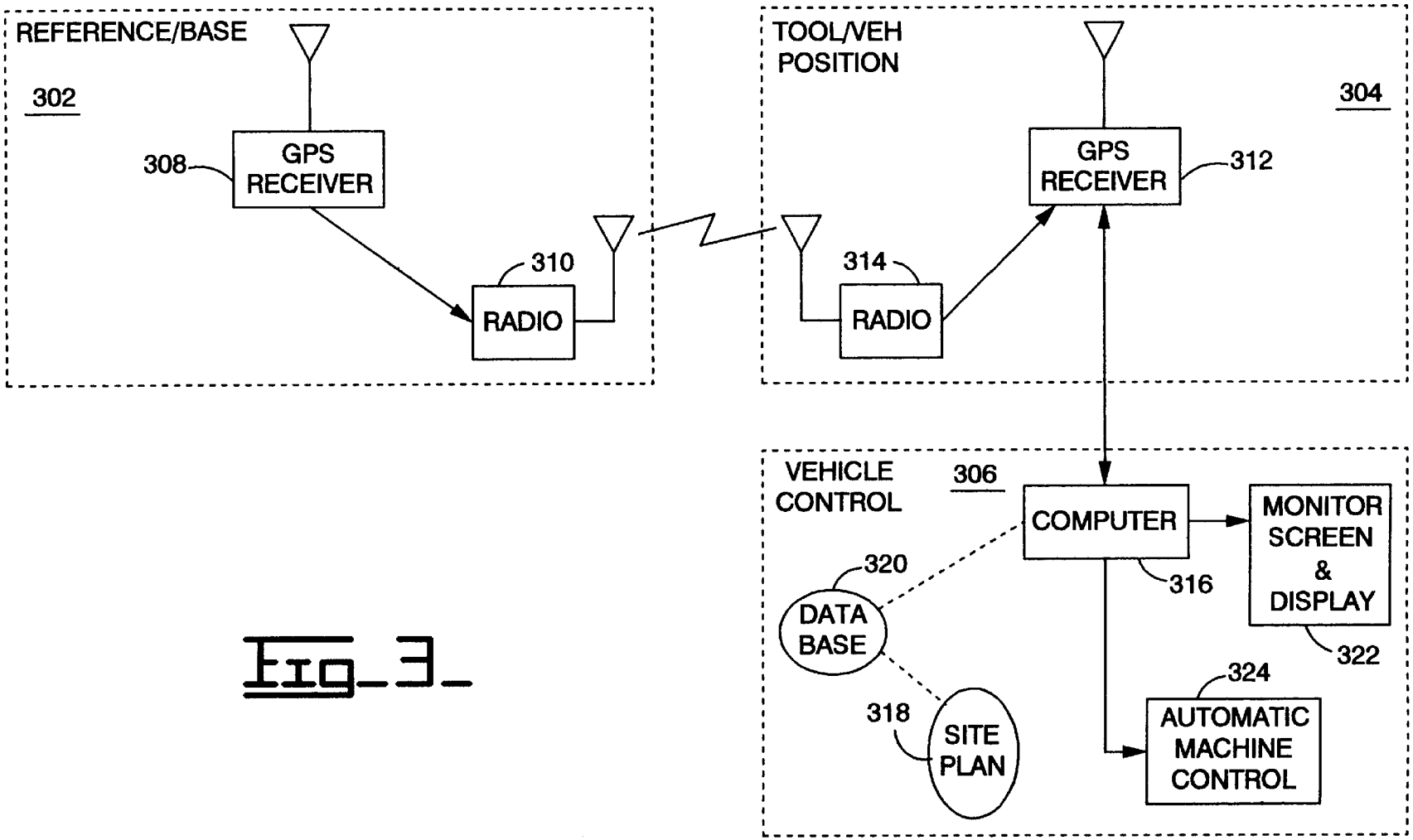
FIG. 3 is a detailed schematic representation of an embodiment of the system of FIG. 2 using GPS positioning.

Referring now to FIG. 3, a more detailed schematic of a system according to FIG. 2 is shown using kinematic GPS for position reference signals. A base reference module 302 and a position module 304 together determine the three-dimensional coordinates of the geography-altering machine relative to the site, while an update/control module 306 converts this position information into real time representations of the site which can be used to accurately monitor and control the machine.

Base reference module 302 includes a stationary GPS receiver 308 and a digital transceiver-type radio 310 connected to the GPS receiver 308 and capable of transmitting a digital data stream. In the illustrative embodiment base reference receiver 308 is a high accuracy kinematic GPS receiver. One suitable GPS receiver is available from Trimble Navigation Limited of Sunnyvale, Calif. as model Trimble 740 GPS Receiver. Radio 310 is a commercially available digital data transceiver.

Position module 304 comprises a matching kinematic GPS receiver 312 and a matching transceiver-type digital radio 314 which receives signals from radio 310 in base reference module 302. In the illustrative embodiment position module 304 is located on the geography-altering machine to move with it over the work site.

Update/control module 306, also carried on board the machine in the illustrated embodiment, includes a computer 316, receiving input from position module 304; one or more digitized site models 318 digitally stored or loaded into the computer memory; a dynamic database update module 320, also stored or loaded into the memory of computer 316; and a color operator display screen 322 connected to the computer. Instead of, or in addition to, operator display 322, automatic machine controls 324 can be connected to the computer to receive signals which operate the machine in an autonomous or semi-autonomous manner in known fashion.

Although update/control module 306 is here shown mounted on the mobile machine, some or all portions may be stationed remotely. For example, computer 316, site model(s) 318, and dynamic database 320 could be connected by radio data link to position module 304 and operator display 322 or machine control interface 324. Position and site update information can then be broadcast to and from the machine for display or use by operators or supervisors both on and off the machine.

Base reference station 302 is fixed at a point of known three-dimensional coordinates relative to the work site. Through receiver 308 base reference station 302 receives position information from a GPS satellite constellation, using the reference GPS software 308 to derive a set of measurements. These measurements include pseudoranges, i.e., an estimate of the distance between the receiver and each of the satellites. The measurements are broadcast from base station 302 to position station 304 on the mobile machine via radio link 310, 314. Alternatively, raw position data can be transmitted from base station 302 to position station 304 via radio link 310, 314, and processed by the GPS receiver 312.

Machine-mounted receiver 312 receives the position information from the satellite constellation and determines the position of the receiver 312 as a function of the measurements from GPS receiver 308 and the position information received from the satellite constellation. This position information is three-dimensional (e.g., latitude, longitude and elevation) and is available on a point-by-point basis according to the sampling rate of the GPS system.

Referring to update/control module 306, once the digitized plans or models of the site have been loaded into computer 316, dynamic database 320 generates signals representative of the difference between actual and desired site geography to display this difference graphically on operator display screen 322. For example, profile and/or plan views of the actual and desired site models are combined on screen 322 and the elevational difference between their surfaces is indicated. Using the position information received from position module 304, the database 320 also generates a graphic icon of the machine superimposed on the actual site model on display 322 corresponding to the actual position and direction of the machine on the site.

Because the sampling rate of the position module 304 results in a time/distance delay between position coordinate points as the machine moves over the site, the dynamic database 320 of the present invention uses a differencing algorithm to determine and update in real-time the path of the machine.

With the knowledge of the machine's exact position relative to the site, a digitized view of the site, and the machine's progress relative thereto, the operator can maneuver the machine over the site to perform various geography-altering operations without having to rely on physical markers placed over the surface of the site. And, as the operator moves the machine over the site the dynamic database 320 continues to read and manipulate incoming position information from module 304 to dynamically update both the machine's position relative to the site, the path of the machine over the site, and any change in actual site geography effected by the machine's passage. This updated information is used to generate representations of the site and can be used to direct the operation of the machine in real time to bring the actual, updated site geography into conformity with the desired site model.

Figure 4:
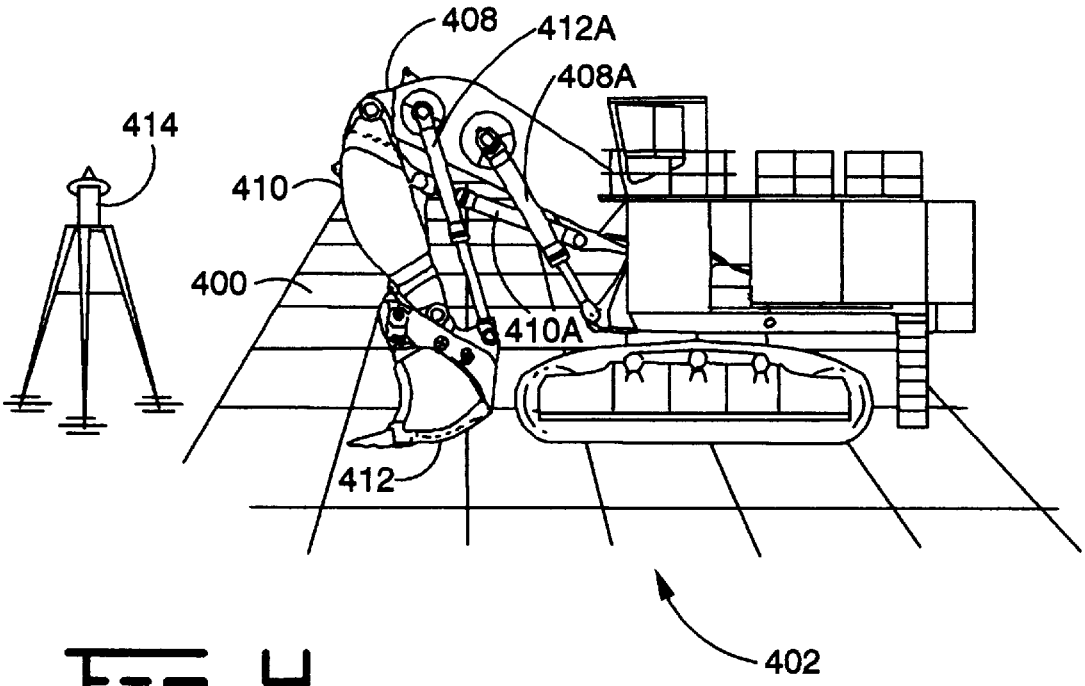
FIG. 4 is a schematic representation of a work site, geography altering machine, and position and control system according to an illustrative earth contouring embodiment of the present invention.

Referring to FIG. 4, a geography altering machine 402 is shown on location at a construction site 400. In the illustrative embodiment of FIG. 4 machine 402 is a mining shovel which performs earthmoving and contouring operations on the site. It will become apparent, however, that the principles and applications of the present invention will lend themselves to virtually any mobile tool or machine with the capacity to move over or through a work site and alter the geography of the site in some fashion.

Machine 402 is equipped in known fashion with available hydraulic or electrohydraulic tool controls for a work implement 404. Work implement 404 includes a boom 408, stick 410, and bucket 412. In the front shovel contouring embodiment of FIG. 4 these controls operate, among other things, boom, stick, and bucket cylinders 408A, 410A, 412A to maneuver bucket 412 in three dimensions for desired cut, fill and carry operations.

Machine 402 is equipped with a positioning system capable of determining the position of the machine and/or its site-altering tool 412 with a high degree of accuracy. In the embodiment of FIG. 4, a phase differential GPS receiver 318 located on the machine at fixed, known coordinates relative to the site-contacting portions of the tracks. Machine-mounted receiver 318 receives position signals from a GPS constellation and an error/correction signal from base reference 308 via radio link 310, 326 as described in FIG. 3. Machine-mounted receiver 318 uses both the satellite signals and the error/correction signal from base reference 308 to accurately determine its position in three-dimensional space. Alternatively, raw position data can be transmitted from base reference 308, and processed in known fashion by the machine-mounted receiver system to achieve the same result. Information on kinematic GPS and a system suitable for use with the present invention can be found, for example, in U.S. Pat. No. 4,812,991 dated Mar. 14, 1989 and U.S. Pat. No. 4,963,889 dated Oct. 16, 1990, both to Hatch. Using kinematic GPS or other suitable three-dimensional position signals from an external reference, the location of receiver 318 and machine 402 can be accurately determined on a point-by-point basis within a few centimeters as machine 402 moves over site 400. The present sampling rate for coordinate points using the illustrative positioning system is approximately one point per second.

The coordinates of base receiver 308 can be determined in any known fashion, such as GPS positioning or conventional surveying. Steps are also being taken in this and other countries to place GPS references at fixed, nationally surveyed sites such as airports. If site 400 is within range (currently approximately 20 kilometers) of such a nationally surveyed site and local GPS receiver, that local receiver can be used as a base reference. Optionally, a portable receiver such as 308, having a tripod-mounted GPS receiver, and a rebroadcast transmitter can be used. The portable receiver 308 is surveyed in place at or near site 400 as previously discussed.

Also shown in schematic form on the mining shovel of FIG. 4 is an on-board digital computer 322 including a dynamic database and a color graphic operator display 322. Computer 322 is connected to receiver 318 to continuously receive machine position information. Although it is not necessary to place computer 322, the dynamic database and the operator display on tractor 402, this is currently a preferred embodiment and simplifies illustration.

Figure 5A:
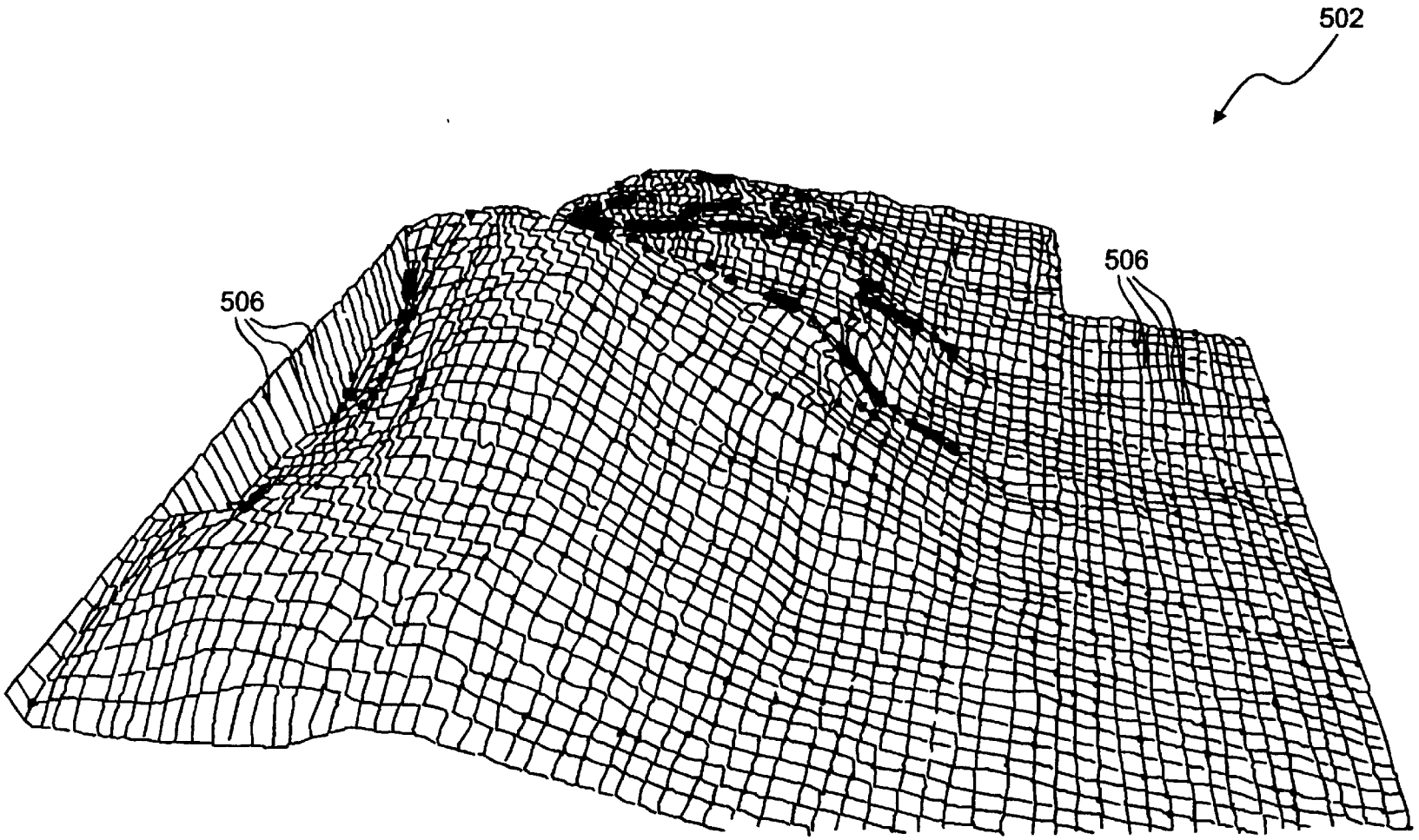
FIGS. 5A–5B are graphic reproductions of exemplary digitized site models such as used with the present invention.
Figure 5B:
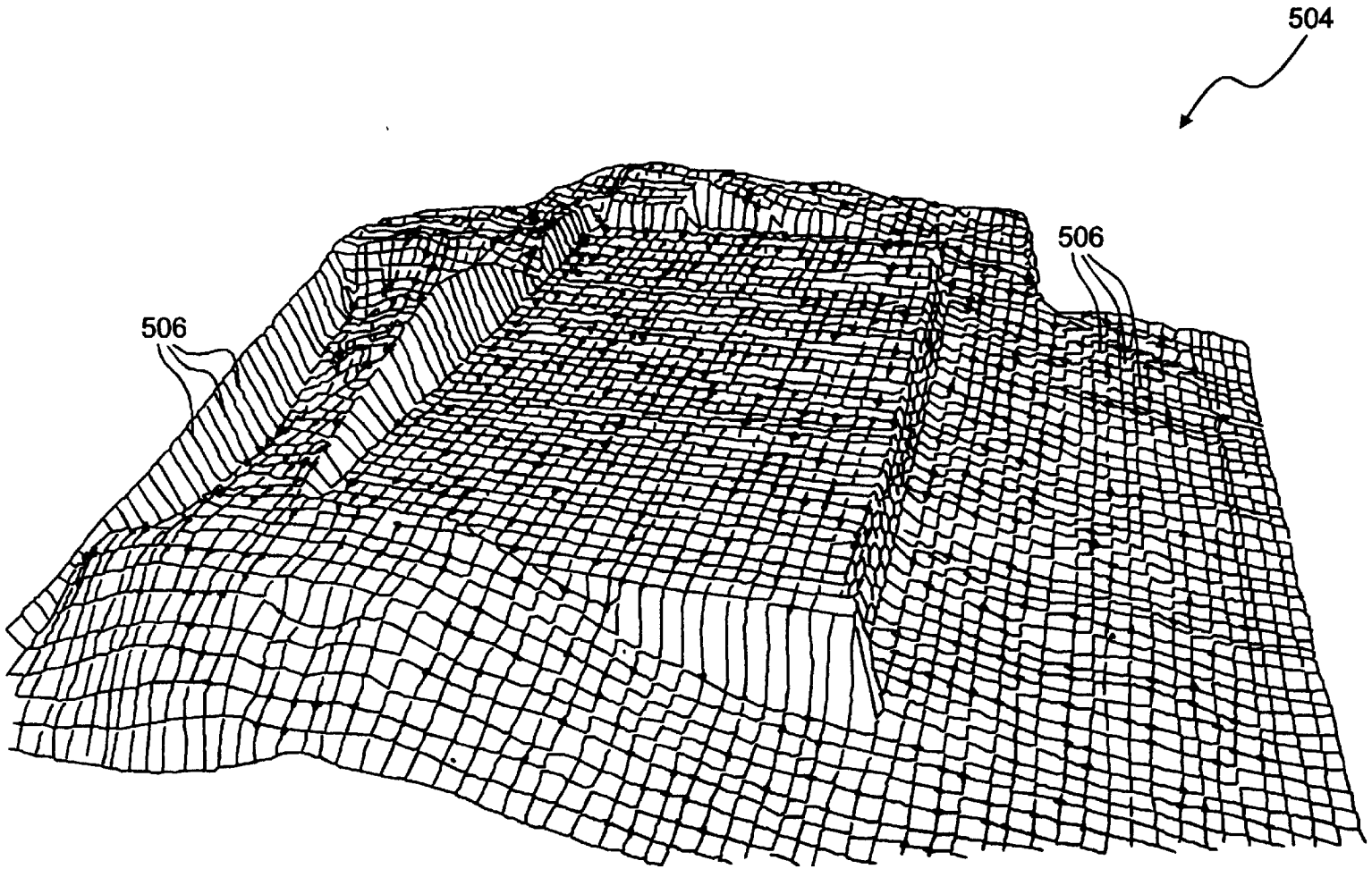

Referring to FIGS. 5A–5B, site 400 has previously been surveyed to provide a detailed topographic blueprint (not shown) showing the architect's finished site plan overlaid on the original site topography in plan view. The creation of geographic or topographic blueprints of sites such as landfills, mines, and construction sites with optical surveying and other techniques is a well-known art; reference points are plotted on a grid over the site, and then connected or filled in to produce the site contours on the blueprint. The greater the number of reference points taken, the greater the detail of the map.

Systems and software are currently available to produce digitized, two- or three-dimensional maps of a geographic site. For example, the architect's blueprint can be converted into three-dimensional digitized models of the original site geography or topography as shown at 502 in FIG. 5A and of the desired site model as shown at 504 in FIG. 5B. The site contours can be overlaid with a reference grid of uniform grid elements 506 in known fashion. The digitized site plans can be superimposed, viewed in two or three dimensions from various angles (e.g., profile and plan), and color coded to designate areas in which the site needs to be machined, for example by removing earth, adding earth, or simply left alone. Available software can also estimate the quantity of earth required to be machined or moved, make cost estimates and identify various site features and obstacles above or below ground. Additionally, the digitized site plan may include defined areas of various ore types or grades or ore.

However site 400 is surveyed, and whether the machine operators and their supervisors are working from a paper blueprint or a digitized site plan, the prior practice is to physically stake out the various contours or reference points of the site with marked instructions for the machine operators. Using the stakes and markings for reference, the operators must estimate by sight and feel where and how much to cut, fill in, carry or otherwise contour or alter the original geography or topography to achieve the finished site plan. Periodically during this process the operator's progress is manually checked to coordinate the contouring operations in static, step-by-step fashion until the final contour is achieved. This manual periodic updating and checking is labor-intensive, time consuming, and inherently provides less than ideal results.

Moreover, when it is desired to revise the blueprint or digitized site model as an indicator of progress to date and work to go, the site must again be statically surveyed and the blueprint or digitized site model manually corrected off-site in a non-real time manner.

To eliminate the drawbacks of prior art static surveying and updating methods, the present invention integrates accurate three-dimensional positioning and digitized site mapping with a dynamically updated database and operator display for real-time monitoring and control of the site 400 and machine 402. The dynamic site database determines the difference between the actual and desired site model geographies, receives kinematic GPS position information for machine 402 relative to site 400 from position receiver 318, displays both the site model and the current machine position to the operator on display 322, and updates the actual site model geography, machine position and display in real time with a degree of accuracy measured in centimeters. The operator accordingly achieves unprecedented knowledge of and control over the earthmoving operations in real time, on-site, and can accordingly finish the job with virtually no interruption or need to check or re-survey the site.

Figure 6:
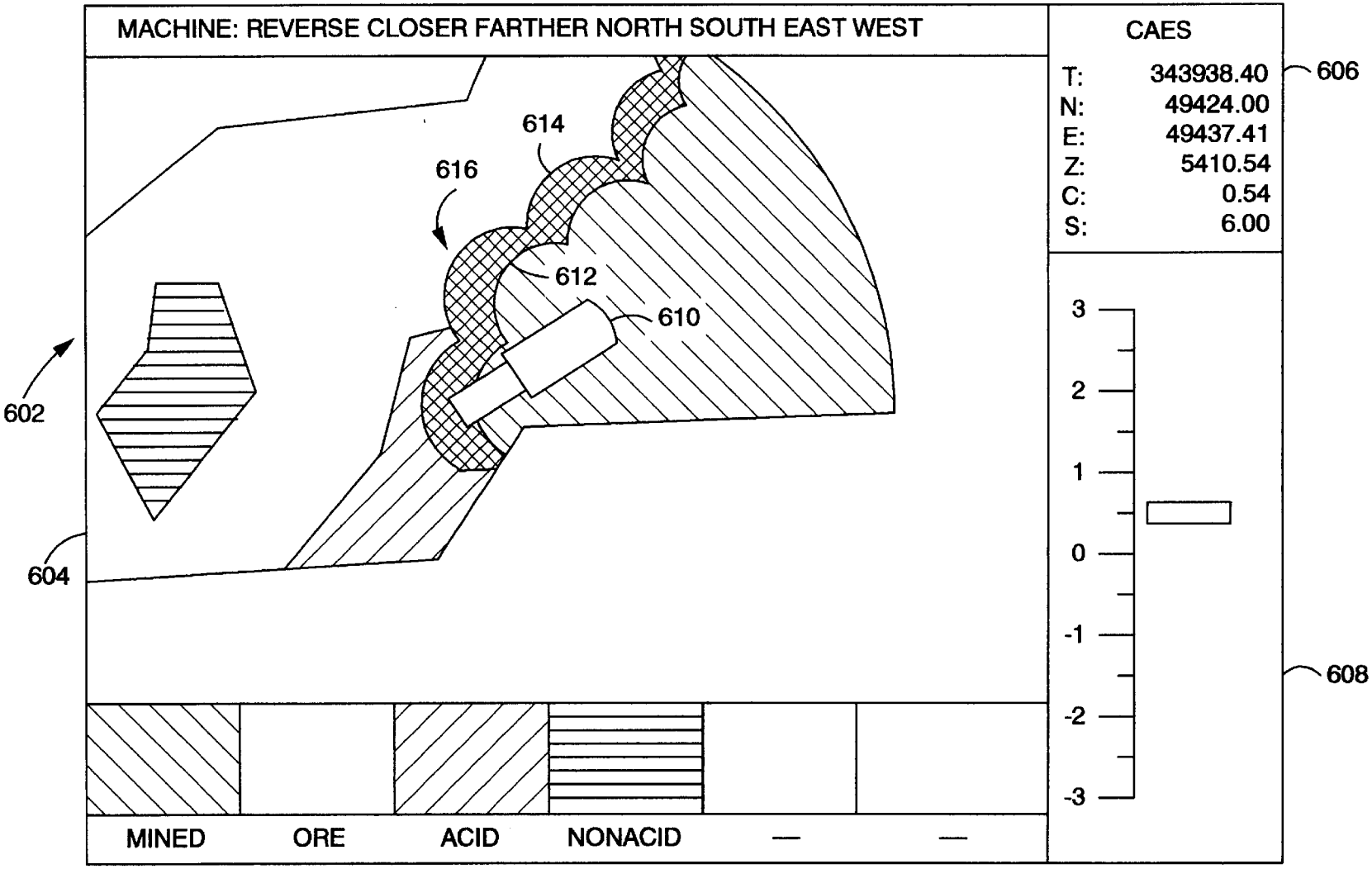
FIG. 6 is a representative real-time operator display generated according to the present invention for an earth contouring operation as in FIG. 4.

Referring now to FIG. 6, an illustrative display available to the machine operator on screen 602 are shown for the topographical contouring application of FIG. 4. An operator display on screen 602 has as a principal component a three-dimensional digitized site model in plan window 604 showing the desired final contour or plan of site 400 (or a portion thereof) relative to the actual topography. On an actual screen display 304 the difference between the actual site topography and the desired site model are more readily apparent, since color coding or similar visual markers are used to show areas in which earth must be removed, areas in which earth must be added, and areas which have already achieved conformity with the finished site model. The differently shaded or cross-hatched regions on the site displayed in window 604 graphically represent the varying ore types or grades or ore. In the preferred embodiment, these regions are differentiated on screen by color.

Operator display screen 602 includes a horizontal coordinate window or display 606 at the top of the screen, showing the operator's position in three dimensions relative to base reference 414. Sidebar scales show the elevational or z-axis deviation from the target contour elevation, providing an indicator of how much the bucket 412 should cut or fill at that location.

The position of the mining shovel on site 400 is displayed graphically on screen 604 as a machine icon 610 superimposed on the plan window 604.

With the detailed position, direction and target contour information provided to the operator via display 602, centimeter-accurate control can be maintained over the earth moving operations. Also, the operator has a complete, up-to-date, real-time display of the entire site, progress to date, and success in achieving the desired topography. At the end of the day the digitized site model in the database has been completely updated, and can simply be stored for retrieval the following day to begin where the operator stopped, or off-loaded for further analysis.

Figure 7:
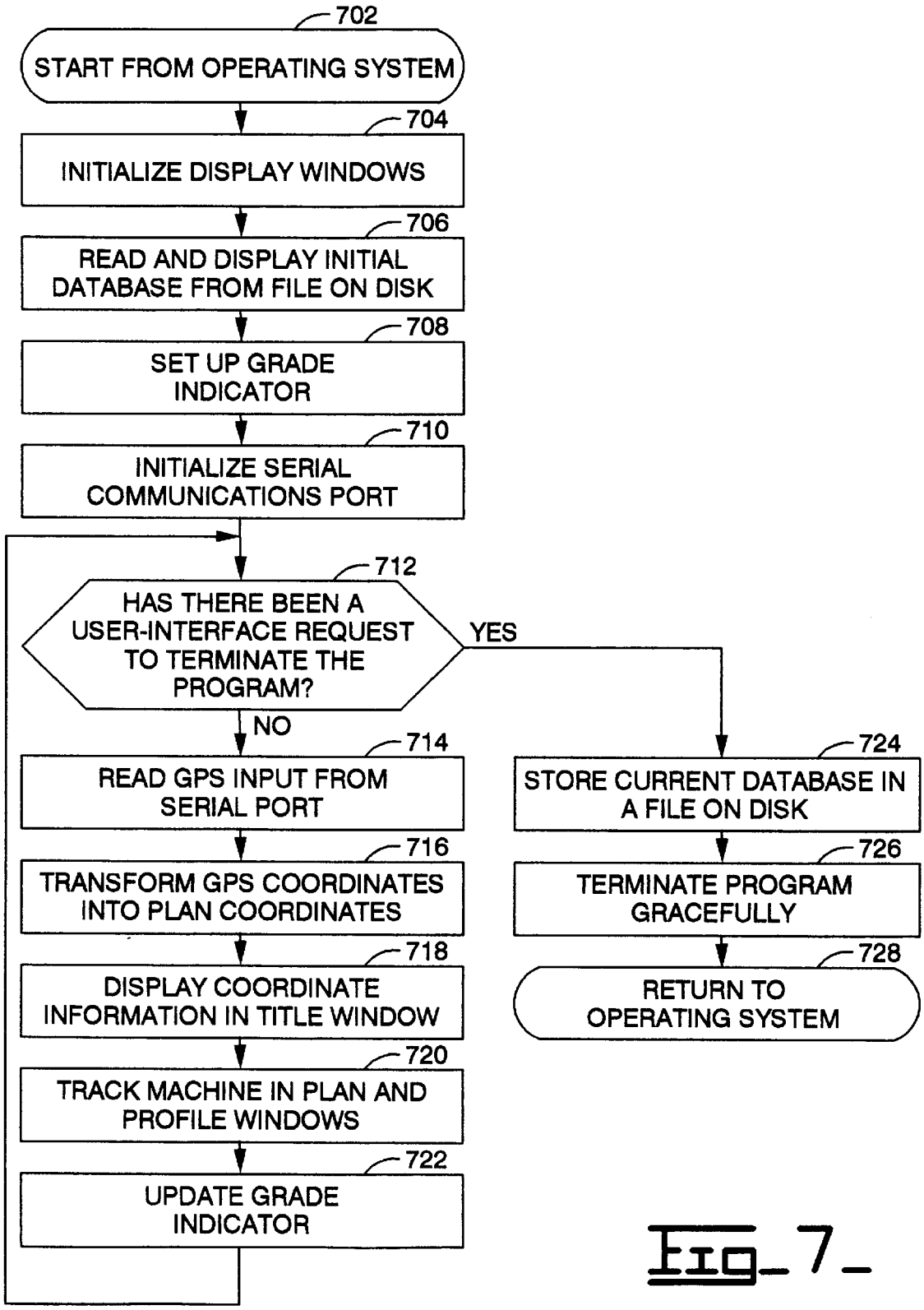
FIG. 7 is a flowchart representation of a dynamic site database according to the present invention.

Referring to FIG. 7, the operational steps of the dynamic database 320 for the machine contouring operation are shown schematically. The system is started at 702 from the computer's operating system. The graphics for the display screens are initialized at 704. The initial site database (a digitized site plan) is read from a file in the program directory, and the site plan and actual and target topography are drawn on the display at step 706. The side bar grade indicator from display 602 is set up at step 708, and the various serial communication routines among modules 302, 304, 306 (FIG. 3) are initialized at step 710. At step 712 the system checks for a user request to stop the system, for example at the end of the day, or for meal breaks or shift changes. The user request to terminate at step 712 can be entered with any known user-interface device, for example a computer keyboard or similar computer input device, communicating with computer 316.

The machine's three-dimensional position is next read at step 714 from the serial port connection between position module 304 and control/update module 306 in FIG. 3. At step 716 the machine's GPS position is converted to the coordinate system of the digitized site plans, and these coordinates are displayed on screen 602 at step 718. At step 720 the machine path is determined in both plan and profile views, and updated in real time to indicate the portions of the site plan grid over which the machine has operated. In the machine contouring embodiment, the width of the machine path is equated to its geography-altering tool (bucket 412) as it passes over the site. An accurate determination of the grid squares over which bucket 412 passes is necessary to provide real time updates of the operator's position and work on the dynamic site plan.

Figure 9:
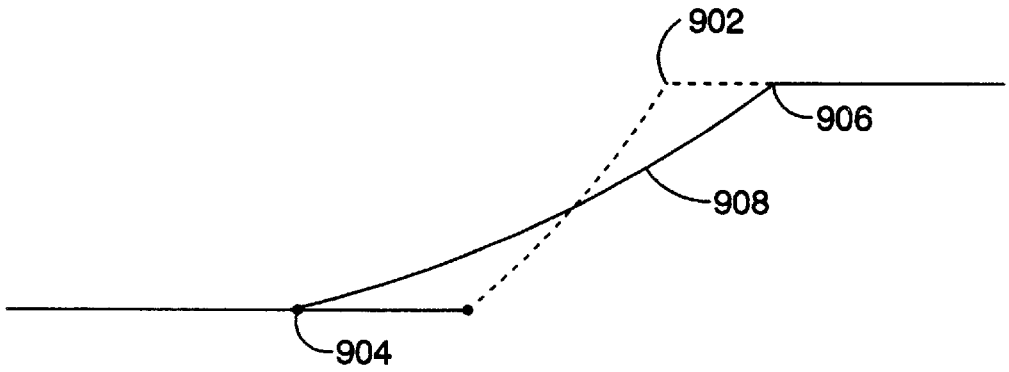
FIG. 9 is a side view of a cut by the mining shovel graphically illustrated.

The present invention is adapted to determine and display a "swath" path. In FIG. 9 a side view of a cut by the mining shovel is graphically illustrated. A dotted line 902 represents the cutting path of the tip of the bucket 412. After the cut is made, the material or ore falls or slides into the lower surface. A point 904 located on the surface on which the mining shovel is located is called the "toe". A point 906 located on the upper surface is called the "crest". The surface of the ore between the points is represented by line 908. Toe point 904, crest point 906 and line 908 represent the swath path.

Returning to FIG. 6, the swath path 616 is graphically illustrated. Dotted line 612 represented a series of toe points and dotted line 614 represents a series of crest points. The swath path is illustrated by the cross hatched area. In the preferred embodiment, the swath path 616 is illustrated via color.

In the preferred embodiment during a cutting operation, the swath path is determined as described below. A reference point located on the machine is defined. For example, on the mining shovel, the reference point is defined as the center of rotation. However, the reference point could be defined with respect to the tracks of the machine. During the cutting operation, the toe is defined as the reference point or a function of the reference point. The exact location of the toe with respect to the machine will be a function on the type of machine and its specific geometry. Next, the crest is determined as a function of the toe point and the angle of repose of the ore being excavated. The angle of repose is dependent upon the type of material. The toe point and the angle or repose are then utilized to determine the crest point. The site database is then updated to include this information.

At step 722, the grade indicator on the display is updated and the system completes its loop and returns to step 712.

At step 712 the option is available to the operator to stop the system as described above, for example at the end of the day or at lunchtime. If the operator chooses at step 712 to stop the system, the system proceeds to step 724 where the current database is stored in a file on a suitable digital storage medium in the system computer, for example, a permanent or removable disk. At step 726 the operations of the differencing module are terminated, and at step 728 the operator is returned to the computer operating system. If the operator does not quit the system, it returns to step 714 where subsequent position readings are taken from the serial port connected to position module 304 and receiver 318, and the system loop repeats itself.

While the system and method of the illustrated embodiment of FIG. 7 are directed to providing real time machine position and site update information via a visual operator display, it will be understood by those skilled in the art that the signals generated which represent the machine position and site update information can be used in a non-visual manner to operate known automatic machine controls, for example electrohydraulic machine and/or tool control system.

Figure 8:
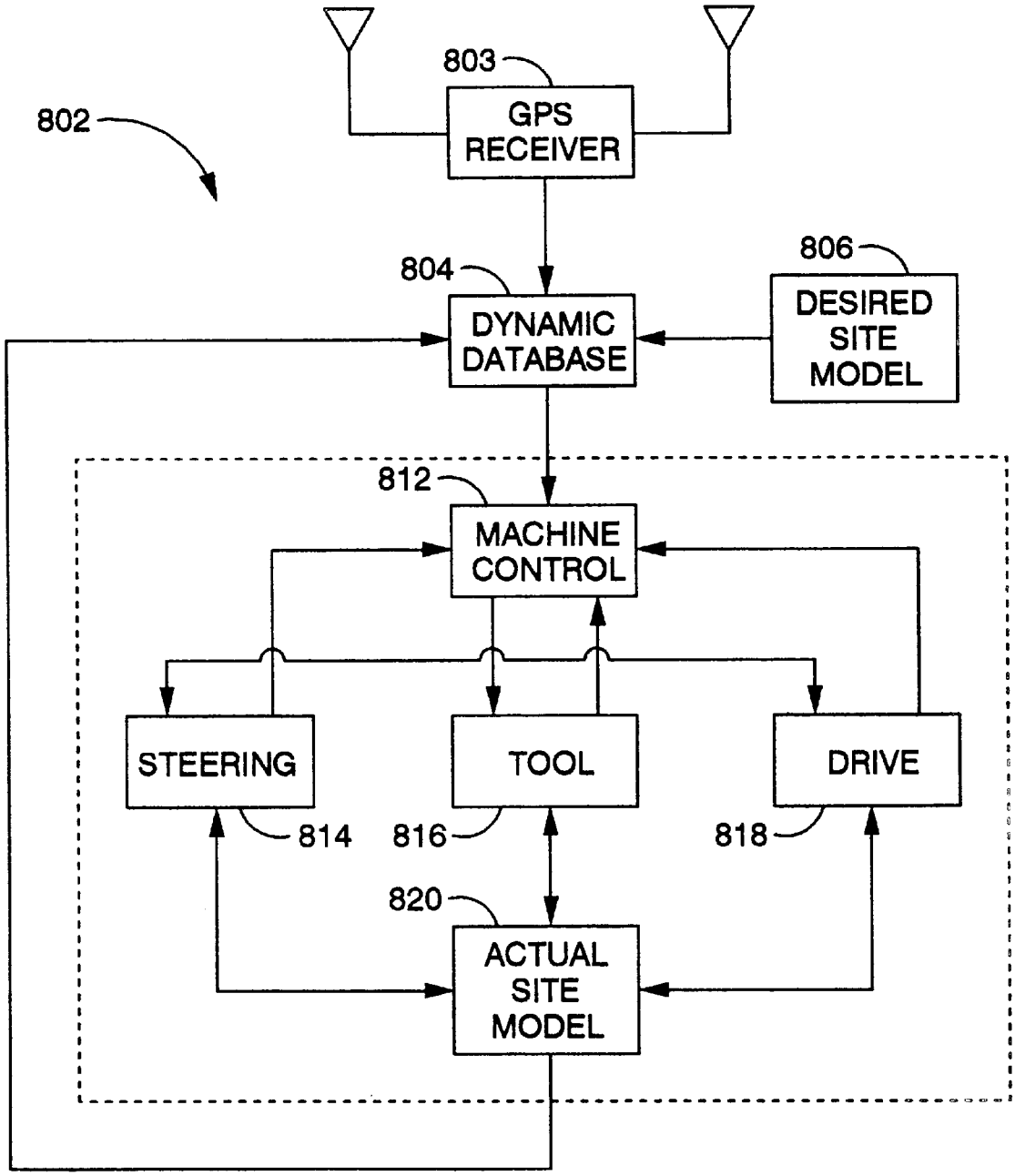
FIG. 8 is a schematic representation of the system of the present invention including a closed-loop automatic machine control system.

Referring now to FIG. 8, a system according to the present invention is schematically shown for closed-loop automatic control of one or more machine or tool operating systems. While the embodiment of FIG. 8 is capable of use with or without a supplemental operator display as described above, for purposes of this illustration only automatic machine controls are shown. A suitable digital processing facility, for example a computer as described in the foregoing embodiments, containing the algorithms of the dynamic database of the invention is shown at 802. The dynamic database 804 receives 3-D instantaneous position information from GPS receiver system 803. The desired digitized site model 808 is loaded or stored in the database of computer 802 in any suitable manner, for example on a suitable disk memory. Automatic machine control module 810 contains electrohydraulic machine controls 812 connected to operate, for example, steering, tool and drive systems 814, 816, 818 on the geography-altering machine. Automatic machine controls 812 are capable of receiving signals from the dynamic database in computer 802 representing the difference between the actual site model 820 and the desired site model 808 to operate the steering, tool and drive systems of the machine to bring the actual site model into conformity with the desired site model. As the automatic machine controls 812 operate the various steering, tool and drive systems of the machine, the alterations made to the site and the current position and direction of the machine are received, read and manipulated by the dynamic database at 804 to update the actual site model. The actual site update information is received by database 804, which correspondingly updates the signals delivered to machine controls 812 for operation of the steering, tool and drive systems of the machine as it progresses over the site to bring the actual site model into conformity with the desired site model.

It will be apparent to those skilled in the art that the inventive method and system can be easily applied to almost any geography altering, machining or surveying operation in which a machine travels over or through a work site to monitor or effect some change to the site geography in real-time. The illustrated embodiments provide an understanding of the broad principles of the invention, and disclose in detail a preferred application, and are not intended to be limiting. Many other modifications or applications of the invention can be made and still lie within the scope of the appended claims.

What is claimed is:

1. Apparatus for directing the operations of a mobile geography-altering machine having a work implement, the implement including a bucket, comprising:

(a) digital data storage and retrieval means for storing a first three-dimensional geographic site model representing the desired geography of a site and a second three-dimensional geographic site model representing the actual geography of the site;

(b) means for generating digital signals representing in real time the instantaneous position in three-dimensional space of at least a portion of the machine as it traverses the site;

(c) means for receiving the signals and for updating the second model in accordance therewith;

(d) means for determining the difference between the first and second models in real time and for determining a swath path related to a cutting contour of said bucket; and (e) means for directing the operation of the machine in accordance with the difference to bring the undated second model into conformity with the first model and for graphically displaying the swath path.

2. An apparatus for displaying information to an operator of a mobile geography-altering machine comprising:

a three-dimensional positioning system located on the mobile geography-altering machine for determining the three dimensional position of the mobile geography-altering machine;

a digital processor located on the machine for receiving position signal from the three-dimensional position system, determining a swath path related to a cutting operation of the mobile geography-altering machine and for maintaining a digitized site model of the actual site geography;

a display screen coupled to the digital processor for graphically displaying site information contained in the digitized site model including the swath path to the operator.

3. An apparatus, as set forth in claim 2, wherein said swath path is defined by a series of toe and crest points.

4. An apparatus, as set forth in claim 3, wherein said machine includes a bucket, said swath path being related to said cutting contour of said bucket.

5. An apparatus, as set forth in claim 2, wherein said toe point is located on a first surface, and said crest point is located on a second surface.

6. An apparatus, as set forth in claim 5, wherein said swath path includes an angle of repose located between said toe point and said crest point.

7. A method for displaying information to an operator of a mobile geography-altering machine including the steps of:

determining the three dimensional position of the mobile geography-altering machine using a three-dimensional positioning system;

receiving position signal from the three-dimensional position system, determining a swath path related to a cutting operation of the mobile geography-altering machine and maintaining a digitized site model of the actual site geography;

graphically displaying site information contained in the digitized site model including the swath path to the operator.

8. A method, as set forth in claim 7, wherein said machine includes a bucket, said swath path being related to said cutting contour of said bucket.

9. A method, as set forth in claim 8, including the step of defining said swath path as including a toe point and a crest point and an angle of repose of said material between said toe point and said crest point.

10. A method, as set forth in claim 9, wherein said toe point is on a first surface and said crest point is on a second surface.

11. An apparatus for directing the operations of an earth moving machine having a work implement comprising:

(a) digital data storage and retrieval means for storing a first three-dimensional geographic site model representing the desired geography of a site and a second three-dimensional geographic site model representing the actual geography of the site;

(b) means for generating digital signals representing in real time the instantaneous position in three-dimensional space of at least a portion of the machine as it traverses the site;

(c) means for receiving the signals and for updating the second model in accordance therewith;

(d) means for determining the difference between the first and second models in real time and for determining a swath path related to a cutting contour of said work implement; and (e) means for directing the operation of the machine in accordance with the difference to bring the updated second model into conformity with the first model and for graphically displaying the swath path.

12. An apparatus, as set forth in claim 11, wherein said work implement includes a bucket, said swath path being related to said cutting contour of said bucket.

13. An apparatus, as set forth in claim 12, wherein said swath path includes a toe point and a crest point.

14. An apparatus, as set forth in claim 13, wherein said toe point is on a first surface and said crest point is on a second surface.

15. An apparatus, as set forth in claim 14, wherein said swath path includes an angle of repose of said material, said angle of repose located between said toe point and said crest point.

16. An apparatus, as set forth in claim 15, wherein said crest point is determined as a function of said toe point and said angle of repose.

* * * * *